US007290955B2

(12) United States Patent
Patel et al.

(10) Patent No.: US 7,290,955 B2
(45) Date of Patent: Nov. 6, 2007

(54) BOLD-FINE MULTIPLE WIDTH MARKING INSTRUMENT

(75) Inventors: Amar A. Patel, Arlington Heights, IL (US); Jeffrey Hautzinger, Arlington Heights, IL (US); Marc Colavitti, Lombard, IL (US); Bret R. Marschand, Glendale Heights, IL (US); Jason E. Cantu, Downers Grove, IL (US); John Thompson, Medfield, MA (US)

(73) Assignee: Sanford, L.P., Oak Brook, IL (US)

( * ) Notice: Subject to any disclaimer, the term of this patent is extended or adjusted under 35 U.S.C. 154(b) by 424 days.

(21) Appl. No.: 10/920,777

(22) Filed: Aug. 18, 2004

(65) Prior Publication Data

US 2005/0042015 A1 Feb. 24, 2005

Related U.S. Application Data

(60) Provisional application No. 60/495,986, filed on Aug. 18, 2003.

(51) Int. Cl.
*A47L 13/30* (2006.01)
*B43K 27/00* (2006.01)
*B43K 5/16* (2006.01)

(52) U.S. Cl. ..... 401/264; 401/263; 401/32; 401/116

(58) Field of Classification Search ..... 401/22, 401/23, 29–32, 116, 117, 263, 268, 264
See application file for complete search history.

(56) References Cited

U.S. PATENT DOCUMENTS 2,984,393 A 5/1961 Magnenat ..... 222/501
3,079,894 A * 3/1963 Johmann ..... 401/31
3,336,909 A 8/1967 Diamond ..... 120/44
3,432,446 A * 3/1969 Coppeta ..... 15/104.93

(Continued)

FOREIGN PATENT DOCUMENTS

| | | |
|---|---|---|
| GB | 2 241 882 A | 9/1991 |
| JP | 5-31996 | 4/1993 |
| JP | 8-25889 A | 1/1996 |
| WO | WO-83/01600 A1 | 5/1983 |
| WO | WO 02/064379 A1 | 8/2002 |

OTHER PUBLICATIONS

International Search Report for International PCT Application No. PCT/US2004/026908, dated Oct. 21, 2005.

(Continued)

*Primary Examiner*—David J. Walczak
(74) *Attorney, Agent, or Firm*—Marshall, Gerstein & Borun LLP

(57) ABSTRACT

A marking instrument includes a body formed with a first end and a second end and sealed at the second end to define a fluid reservoir. The marking instrument includes a tip assembly positioned at the first end having a rigid nib with a fluid path formed longitudinally therethrough. The rigid nib has a first end forming a first spreader surface and a second end adjacent to the fluid reservoir and cooperates with a shiftable valve positioned within the fluid path. The shiftable valve includes a valve actuator having a contact surface position substantially adjacent to the first spreader surface. The tip assembly may further include an adjustable nib having a second spreader surface adapted to be positioned adjacent the first spreader surface to form a composite spreader surface.

20 Claims, 6 Drawing Sheets

U.S. PATENT DOCUMENTS

| | | | | |
|---|---|---|---|---|
| 3,609,052 | A | | 9/1971 | Airosus |
| 4,511,273 | A | | 4/1985 | Trotta |
| 4,685,820 | A | | 8/1987 | Kremer et al. |
| 4,812,071 | A | | 3/1989 | Batra et al. |
| 4,838,723 | A | | 6/1989 | Suzuki et al. |
| 4,923,317 | A | * | 5/1990 | Bishop et al. ..... 401/205 |
| 5,026,189 | A | | 6/1991 | Keil ..... 401/29 |
| 5,261,755 | A | | 11/1993 | Draper et al. |
| 5,480,250 | A | | 1/1996 | Birden |
| 5,651,627 | A | | 7/1997 | Dowzall |
| 5,672,021 | A | | 9/1997 | Abber et al. |
| 5,727,893 | A | | 3/1998 | Handler |
| 5,813,787 | A | | 9/1998 | Dowzall et al. |
| 5,885,020 | A | | 3/1999 | Rossi |
| 5,897,265 | A | | 4/1999 | Wilson ..... 401/199 |
| 5,938,360 | A | | 8/1999 | Yen et al. |
| 6,059,477 | A | | 5/2000 | Dunlap, Jr. et al. |
| 6,135,659 | A | | 10/2000 | Ku |
| 6,155,733 | A | | 12/2000 | Holbrook et al. ..... 401/31 |
| 6,196,744 | B1 | | 3/2001 | Landry et al. |
| 6,416,242 | B1 | | 7/2002 | Kaufmann |
| 6,474,893 | B1 | | 11/2002 | Osada et al. |
| 6,488,429 | B2 | | 12/2002 | Korper |
| 6,554,516 | B1 | | 4/2003 | Christopher |
| 6,572,297 | B2 | | 6/2003 | Korper |
| 2001/0003566 | A1 | | 6/2001 | Yoshida et al. |

OTHER PUBLICATIONS

Written Opinion of the International Searching Authority for International PCT Application No. PCT/US2004/026908, dated Oct. 21, 2005.

* cited by examiner

BOLD-FINE MULTIPLE WIDTH MARKING INSTRUMENT

CROSS REFERENCE TO RELATED APPLICATION

This patent claims the priority benefit of U.S. provisional patent application No. 60/495,986, filed on Aug. 18, 2003 and titled "WIDE LINE MARKER FOR FILM FORMING FLUIDS." The disclosure of this provisional patent application is hereby incorporated herein by reference in its entirety for all purposes.

TECHNICAL FIELD

This patent is generally directed to marking instruments, and more particularly to marking instruments adapted to produce even and consistent fine and bold lines using a variety of liquids and film forming fluids.

BACKGROUND

Conventional marking instruments, such as markers, pens, and correction fluid dispensers, typically include a writing tip fluidly connected to a reservoir adapted to store and supply ink or other fluids. Conventional markers incorporating capillary and free fluid reservoirs are generally not suitable for dispensing fluids with viscosities above 5 cp (centipoise). In particular, capillary and free fluid reservoir markers are prone to clogging and low-flow conditions when dispensing high viscosity fluids (e.g., fluids with viscosities greater than 5 cp) because the flow-rates are insufficient for supplying ink or other fluids at normal writing and marking speeds.

FIG. 1 illustrates an exemplary prior art marker 10 having a hollow body 12, a sealing cap 14 and a writing section 16. The body 12 includes a first end 18 adapted to cooperate with the sealing cap 14 to form a cylindrical reservoir. The sealing cap 14 may fixedly or removable attach to the body 12 using a variety of known manufacturing techniques such as, for example, a snap or interference fit system, friction welding the two components together, applying an adhesive to secure the components, and integrally forming a pair of complimentary threaded fasteners into the structure of the two components. Other known markers include the body 12 and sealing cap 14 formed or molded into a single piece during the manufacturing process.

The body 12 further includes a second end 20 distal to the first end 18 and the sealing cap 14. The second end 20 cooperates with the writing section 16 to seal the reservoir and marker 10. The writing section 16 attaches to the second end 20 using any of the manufacturing techniques described in connection with the sealing cap 14. It will be understood that the sealed cylindrical reservoir can be a pressurized reservoir, an unpressurized reservoir, or a capillary reservoir, depending on the intended writing application. Regardless of the chosen reservoir type, the sealed reservoir stores and contains a liquid such as ink, marking fluid and correction fluid dispensable by the writing section 16.

The writing section 16 includes an adaptor ring 22 secured to the second end 20 of the body 12. The adaptor ring 22 may include, for example, an internal friction or bonding surface (not shown) adapted to securely engage the second end 20 to fixedly attach the writing section 16. A generally cone-shaped transition surface 24 integrally connects the adaptor ring 22 to a mounting surface 26 formed distal to the second opening 20.

A marker nib 28 having an integral marker point 30 can, in turn, attach within a receiving pocket (not shown) formed in the mounting surface 26. The receiving pocket secures the marker nib 28 and provides a fluid connection between the liquid stored within the fluid reservoir and the marker point 30. The marker nib 28 and the marker point 30 may be manufactured from a variety of permeable fibrous materials and formed into numerous shapes such as, for example, a rounded point, a knife-shaped wedge, or a cylindrical tip. In addition, a cap 32 removeably engages the transition surface 24 and/or the adaptor ring 22 to protect the marker nib 28 and the marker point against damage, drying, etc.

The body 12 may include a distended pumping portion (not shown) formed adjacent to the writing section 16. The distended pumping portion forms a balloon-like structure adapted to increase the pressure within the body 12 when the balloon-like structure is squeezed. It will be understood that irregularly shaped reservoirs, such as a kidney shaped reservoir, an oval shaped reservoir, and a triangular shaped reservoir may have a single opening for filling and ultimately dispensing the stored liquids.

FIG. 2 illustrates an alternate embodiment of a prior art marker 40 including a second writing section 42 affixed adjacent to the first end 18. Thus, the second writing section 42 cooperates with the hollow body 12 and the first writing section 16 to form the double ended marker 40. In use, the double ended marker 40 produces multiple line thicknesses because the first writing section 16 is configured to produce a narrow or fine line, while the second writing section 42 is configured to produce a bold or wide line Similar to the first writing section 16, the second writing section 42 fixedly or removably attaches to the first end 18 of the body 12 using an adaptor ring 44. The second writing section 42 includes an oversized marker nib 46 having an oversized writing point 48 formed distal to the adaptor ring 44. In operation, the second writing section 42 cooperates with the fluid reservoir to produce a bold or wide line by dispensing a high volume of the stored liquid. As previously discussed, the oversized marker nib 46 and writing surface 48 are typically formed from permeable fibrous materials intended to dispense the stored liquid. In addition, a cap 50 may engage a transition surface 52 integrally formed with the adaptor ring 44 to provide protection for the marker nib 46.

BRIEF DESCRIPTION OF THE DRAWINGS

For a more complete understanding of the disclosed embodiments of the invention and claimed device, reference should be made to the following detailed description and accompanying drawings wherein:

DETAILED DESCRIPTION

Generally, a marker incorporating the teachings of the present invention dispenses fluid through a rigid writing nib, which may or may not include a spreading means. In particular, surface tension encourages the dispensed fluid to flow evenly across a writing surface of the rigid nib to provide an even and consistent line. Further, the rigid nib may include a first rigid nib portion such as, for example, a ball point valve, adapted to dispense a fine line (e.g., approximately 1 to 3 mm wide,) and a second rigid nib portion adapted to cooperate with the first nib portion and dispense a bold line, such as approximately 3 to 10 mm wide. It will be understood that the marking speed and fluid pressure may influence the width and thickness of the dispensed line.

Figure 1:
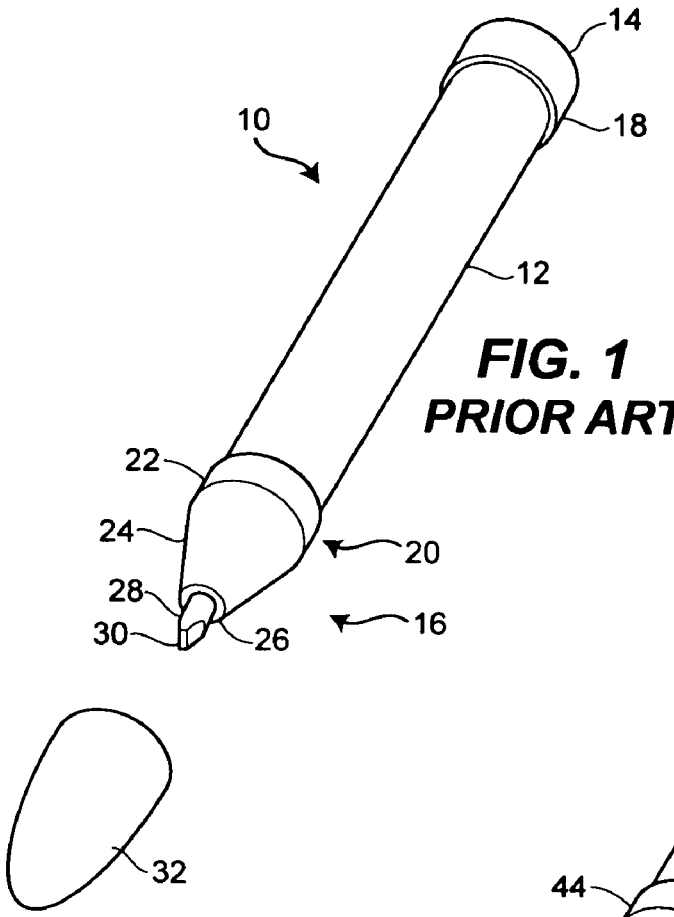
FIG. 1 PRIOR ART
FIG. 1 illustrates a perspective view of a prior art, single tip marking device.
Figure 2:
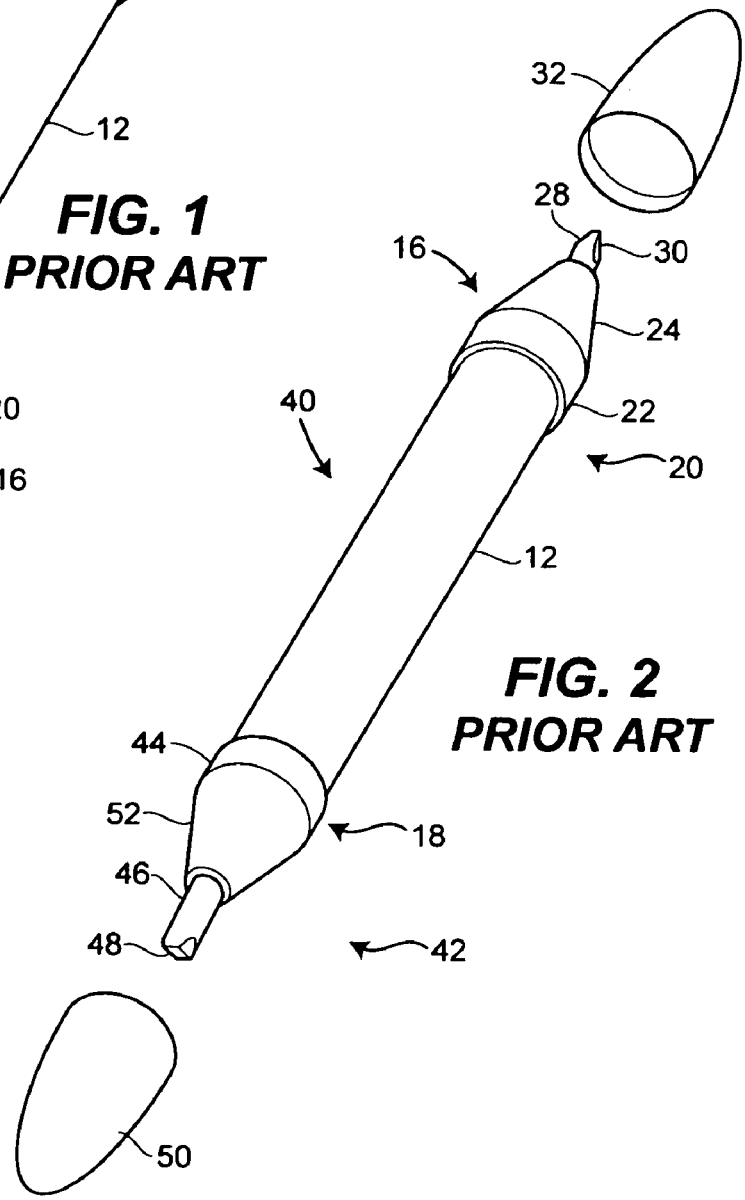
FIG. 2 PRIOR ART
FIG. 2 illustrates a perspective view of a prior art, double ended marking device similar to FIG. 1.
Figure 3:
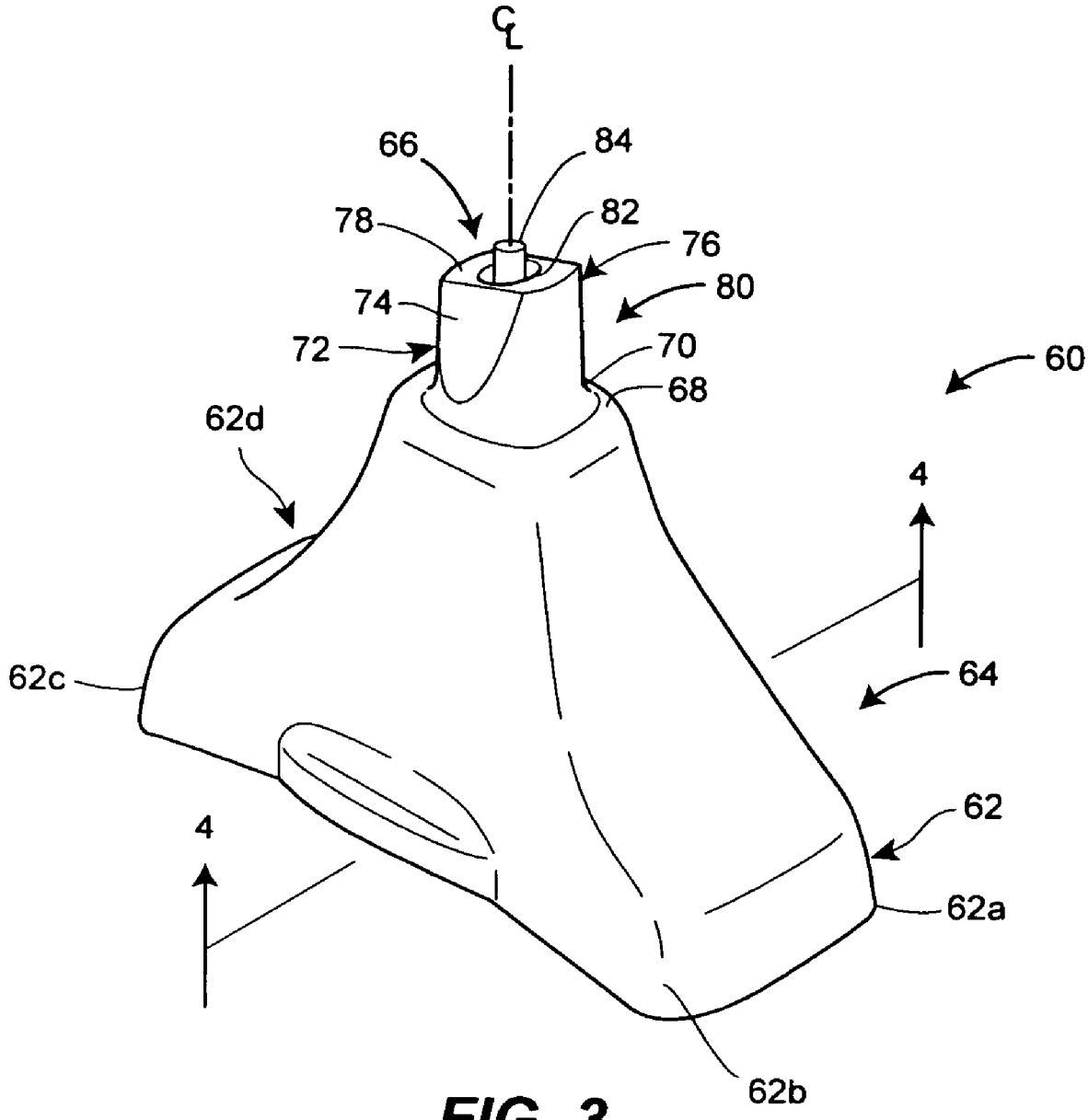
FIG. 3 illustrates a perspective view of an exemplary marking tip constructed in accordance with the teachings of the present disclosure.

FIG. 3 illustrates an exemplary rigid nib assembly 60 constructed in accordance with the teachings of the present invention. While the exemplary rigid nib assembly 60 has a connector 62 having a roughly rectangular cross-section adapted to mate with a roughly rectangular body 12 (see FIG. 4), it will be understood that alternate geometries such as circular, oval, triangular and square can be employed. Moreover, it will be understood that the rigid nib assembly 60 and the body 12 can cooperate to form a squeezable reservoir, a pressurized reservoir with or without a release valve, an unpressurized reservoir, or any other suitable fluid receptacle.

Figure 4:
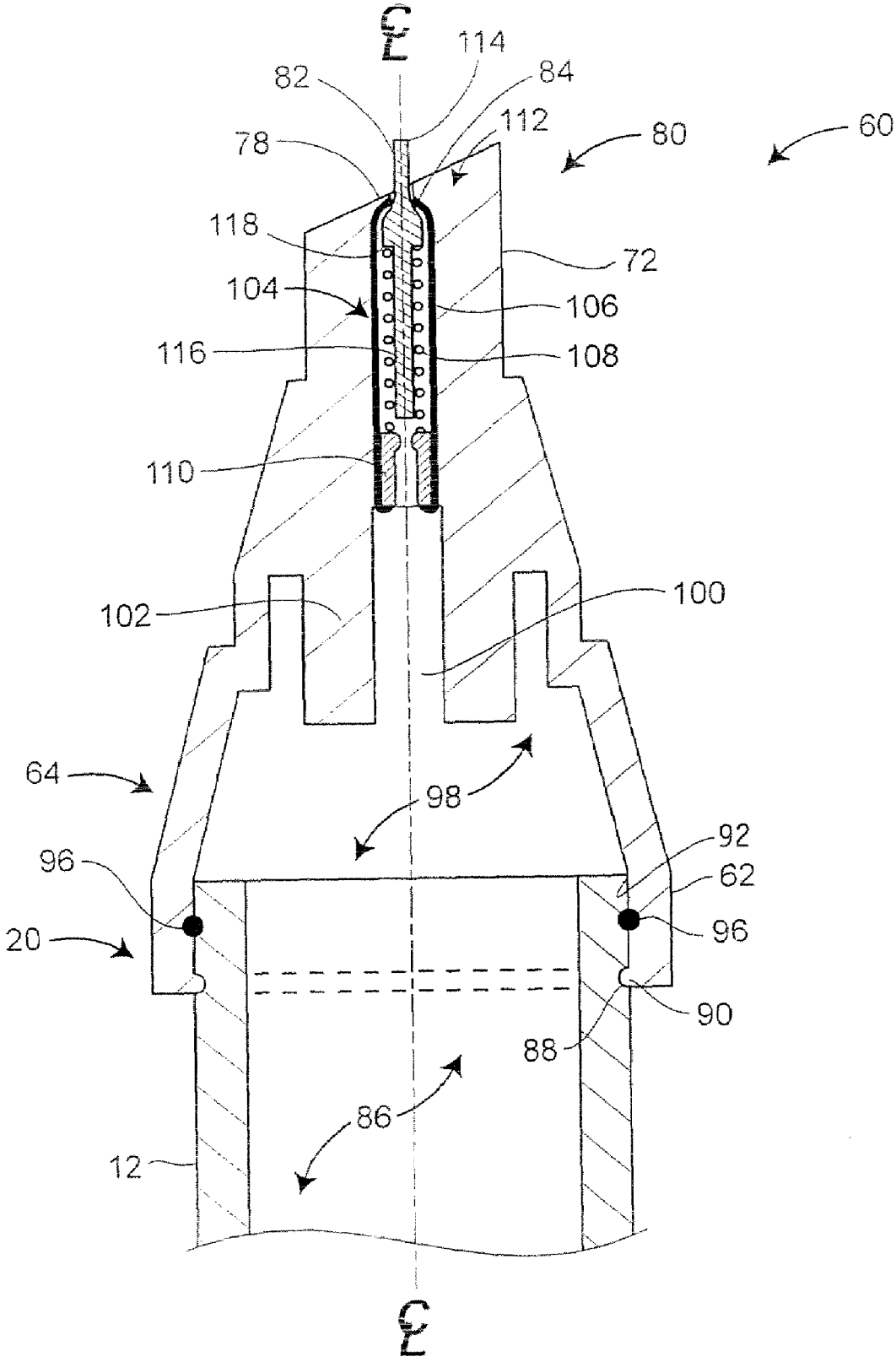
FIG. 4 illustrates a sectional view along the line 44 of the exemplary marking tip shown in FIG. 3.

The connector 62 may incorporate, among other things, internal threading, a pressure seal with or without an o-ring, or a bonding area adapted to sealingly engage the roughly rectangular body 12 (see FIG. 4). For example, the connector bonding area may cooperate with a mating bonding area formed contiguous with the rectangular body 12 to facilitate an interference fit, sonic welding of the two surface, or bonding of the two area by other known attachment means. The connector 62 may further be formed to include a snap-in feature (not shown) to securely engage the roughly rectangular body 12.

The rigid nib assembly 60 forms a single integral unit that may be manufactured from a variety of thermoset and thermoplastic materials such as bakelite, polystyrene (PS), nylon, polyethylene (PE), polypropylene (PP), polyvinylchloride (PVC), polyethylene terephialate (PET), polyoxymethylene (POM) and plastic blends. These thermoplastics can, in turn, be formed using an injection or blow molding process to force the liquid plastic into a suitable mold representing the desired finished component.

The connector 62 further includes a plurality of rounded fillets 62*a*-62*d* adapted to smooth the transition between the roughly rectangular body 12 and a roughly frusto-conical neck 64. The fillets 62*a*-62*d* further provide a smooth or rounded transition around the circumference of the connector 62. In addition, the fillets 62*a*-62*d* may provide the rigid writing nib assembly 60 and connector 62 with an aesthetically pleasing appearance and an ergonomic design.

As with the rounded fillets 62*a*-62*d*, the neck 64 provides a gradual transition between the connector 62 and a cylindrical tip portion 66. In other words, the cross-section of the neck 64 reduces in diameter (i.e., converges towards the centerline CL) as the distance from the connector 62 increases. It will be understood that the cylindrical tip portion 66 can be a separate component secured within the neck 64 and adapted to provide the gradual transition discussed above. Moreover, the neck 64 may include indentations sized to accept fingers and thereby ease writing stress. A generally flat surface 68 defines the terminal end of the neck 64 and integrally connects to the cylindrical tip portion 66.

A shoulder 70 may attach the cylindrical tip portion 66, depicted in this exemplary embodiment as a cylindrical barrel 72, to the generally flat surface 68. The shoulder 70 forms a curved or filleted surface to provide increased structural support and align the cylindrical barrel 72 with the centerline CL. The cylindrical barrel 72 may include a pair of opposing relief surfaces 74, 76 and an angled marking surface 78. The opposing relief surfaces 74, 76 and the angled marking surface 78 cooperate to define a generally chisel shaped nib portion 80.

The cylindrical barrel 72 and the chisel shaped nib portion 80 further include a valve passage 82 (see FIG. 4). The valve passage 82, formed along the centerline CL, provides a fluid connection between the angled marking surface 78 and the fluid reservoir within the body 12. The valve passage 82 is adapted and sized to support a valve unit 104 (see FIG. 4), which may be a self-contained unit or a plurality of cooperating components. The valve unit 104 includes a shiftable pin or valve actuator 84 that extends beyond the angled marking surface 78. In operation, the chisel shaped nib portion 80 is positioned adjacent to a marking substrate surface such that the angled marking surface 78 aligns roughly parallel to the plane defined by the marking substrate. As the chisel shaped nib portion 80 and the angled marking surface 78 engage the marking substrate (not shown), the shiftable pin 84 depresses to open the valve passage 82 and dispense the liquid stored within the fluid reservoir (not shown). The liquid, in turn, spreads across the angled marking surface 78, which acts as a spreading means due to surface tension, and dispenses on the marking substrate.

FIG. 4 illustrates a sectional view of the rigid nib 60 taken along the line 4-4. The body 12, shown as a cutaway, is understood to be sealed at a first end 18 to define a fluid reservoir 86. The body 12 removably attaches, in this exemplary embodiment, to the connector 62 at a second end 20 using a snap-fit arrangement. In particular, the body 12 includes an annular groove 88 sized to accept a corresponding raised ridge 90 formed on an inner surface 92 of the connector 62. The connector 62 and integral raised ridge 90 engage an outer surface 94 of the second end 20 thereby causing the neck 64 and the connector 62 to deform and deflect away from the centerline CL. The deformation and deflection allow the connector 62 to slideably engage the outer surface 94 which, in turn, removeably secures or snaps the raised ridge within the annular groove 88.

An o-ring 96 such as, for example, a TEFLON® o-ring, may be positioned between the inner surface 92 of the connector 62 and outer surface 94 of the body 12 to prevent unwanted leakages of the fluid contained within the fluid reservoir 86. It will be understood that rigid writing nib 60 may alternatively fixedly join to the second end 20 by way of a snap-fit, an interference fit, or using a variety of methods such as glue, epoxy and/or friction welding.

The neck 64 further cooperates with the connector 62 and the second end 20 to define a fluid cavity 98. The fluid cavity 98 extends beyond the second end 20 and may be a pressurized portion of the fluid reservoir 86 or an unpressurized void adapted to mix and redistribute the fluid, with or without particulate matter, contained within the fluid reservoir 86. It will be understood that, in this illustrated embodiment, the dimensions of the fluid cavity 98 mirror the exterior shape of the conical neck 64, and thus the fluid cavity 98 has a roughly frusto-conical shape.

The fluid cavity 98 further includes a fluid passage 100 formed in an annular boss 102 projecting from the conical neck 64 and providing a fluid connection to the valve passage 82. The fluid passage 100 may channel and direct fluid flow between the free flow condition within the reservoir to the channel flow condition within the valve passage 82. In addition, the material required to form the fluid passage 100 may. provide additional structural support of the conical neck 64 and flat surface 68 without detracting from the aesthetic characteristics of the rigid writing nib assembly 60.

The valve unit 104, cooperates with the fluid passage 100 and the valve passage 82 to provide sealable access to the fluid reservoir 86. In other words, the valve unit 104, which may be a preassembled unit, engages the fluid passage 100 to control the flow of liquid to the angled marking surface 78. Advantageously, use of a preassembled or self-contained valve unit 104 entails little if any additional assembly steps because it may be provided in a "ready-to-use" state and must simply be mated with the rigid writing nib assembly 60. However, it may be desirable to assemble the individual valve components within a suitable valve passage 82 and secure the components within a press or interference fit sleeve.

The exemplary self-contained valve unit 104 illustrated in FIG. 4 includes a hollow sheath 106 adapted to enclose and contain the shiftable pin 84, a spring 108 and a retainer 110. The sheath 106 can be stamped, molded or otherwise formed from a thin metallic or plastic material to create a hollow cylinder. A pin retainer lip 112 such as, for example, an annular ring formed by inwardly folding (i.e. folding towards the centerline CL) the sheath 106 material adjacent to the angled writing surface 78, may form a travel stop for the pin 84.

The valve unit 104 may be modified or adapted in to include a number of different valve types depending on the type of pen, the application, cost factors, manufacturability, and other practical concerns. In one alternate embodiment, the shiftable pin 84 can be replaced with a roughly spherical ball adapted to cooperate with the sheath 106 define a ball valve unit or a ball point. Other valve embodiments can include multiple roughly spherical balls, or combinations of shiftable pins 84 and roughly spherical balls.

The exemplary shiftable pin 84 illustrated in FIG. 4 includes a tapered seal surface 114 angled to engage the pin retainer lip 112 to thereby secure and prevent fluid flow through the valve unit 104 and the valve passage 82. The spring 108 biases the shiftable pin 84 to the sealed or closed position insure that the pin 84 engages the pin retainer lip 112. The shiftable pin 84 may further include a stem 116 adapted to engage an inner diameter of the spring 108 and guide the shiftable pin 84 along the centerline CL. In operation, the spring 108 provides an equal and opposite spring force against the retainer 110 and a shoulder 118 of the pin 84 to seal the valve passage 82. Further, as the shiftable pin 84 engages the marking substrate, the tapered seal surface 114 disengages from the pin retainer lip 112 and fluidly connects the angled marking surface 78 to the fluid reservoir 86. In this way, the fluid contained within the fluid reservoir 86 flows through the valve unit 104 and disperses along the angled marking surface 78 to be dispensed on the marking substrate.

The hollow sheath 106 can cooperate with the retainer 110 to secure and support the shiftable pin 84 and the spring 108. It will be understood that the retainer can be a separate annular ring (as shown in the sectional view of FIG. 4) or can be a ring formed by rolling the material of the sheath inward toward the centerline CL. Moreover the sheath 106 can be dimpled or indented around the external circumference to prevent release of the valve components (e.g., the shiftable pin 84 and the spring 108.)

Figure 5:
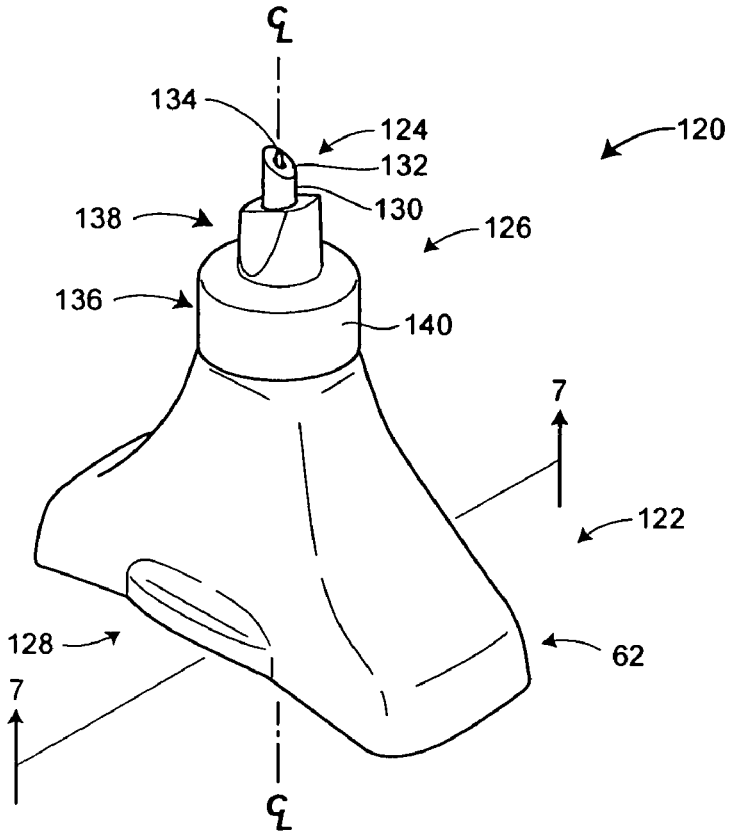
FIG. 5 illustrates a perspective view of an alternate exemplary marking tip in a first position.
Figure 6:
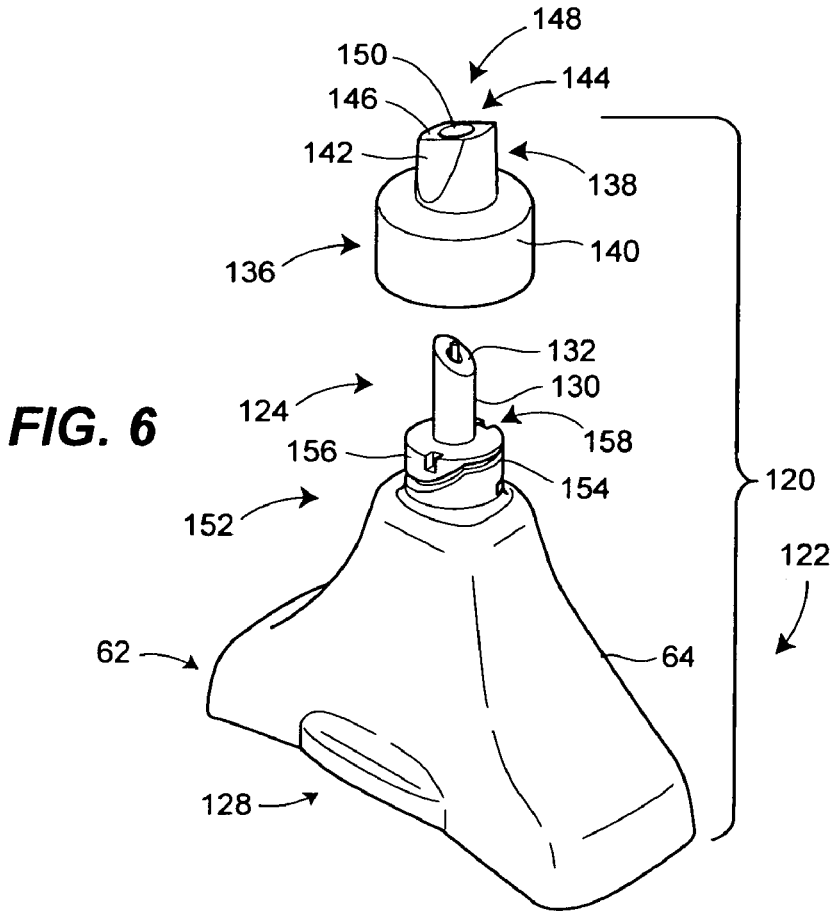
FIG. 6 illustrates an exploded perspective view of the alternate exemplary marking tip shown in FIG. 5.
Figure 7:
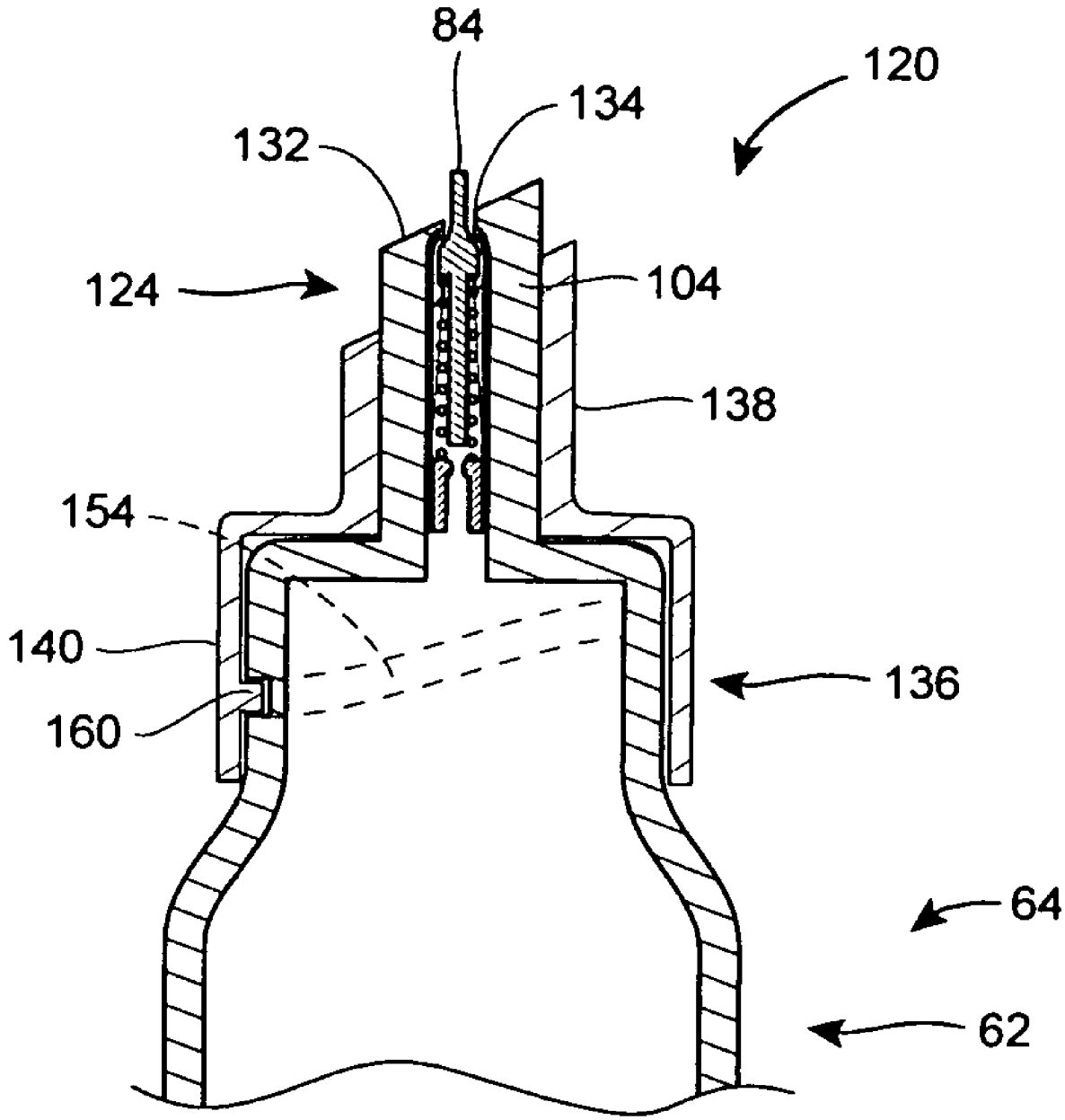
FIG. 7 illustrates a sectional view along the line 7-7 of the alternate exemplary marking shown in FIG. 5.

FIGS. 5-7 illustrate an embodiment of an adjustable rigid tip assembly 120 adapted to produce both bold and fine lines. The adjustable tip assembly 120 includes a rigid body 122, a fixed rigid nib 124 and an adjustable rigid nib 126. The rigid body 122 incorporates the connector 62 and the conical neck 64 into a single integral unit formed and adapted to engage a complimentary marking instrument body (not shown). An assembly lip 128 integral to the connecter 62 facilitates connection and disconnection of the tip assembly 120 to the complimentary body (not shown). In particular, the assembly lip 128 provide 20 engagement mechanism by which the tip assembly 120 can be snapped to, or pried loose from, the complimentary body.

The fixed rigid nib 124 forms an integral portion of the rigid body 122 and includes a cylindrical body 130, a first marking surface 132 and a fluid passage 134. In another embodiment, the fixed rigid nib 124 can simply be a rigid ball point valve or tip. The cylindrical body 130 extends away from the connector 62 along the centerline CL. The first angled marking surface 132, formed at the terminal end of the cylindrical body 130, defines an acute angle relative to a plane defined by the base of the connector 62. The first angled marking surface 132 can be, in turn, oriented and aligned to produce fine lines, such as lines of fluid having a width of approximately 1-3 mm. As described above in connection with FIG. 3, the first angled marking surface 132 can be chisel shaped and include an oblong, rectangular, or oval face or tip to facilitate producing a variety of lines. In operation, the thickness of the line can be varied by reorienting the fixed rigid nib 124 with respect to the marking substrate, such as by rotating the rigid body 122 and the first angled writing surface 132 around the centerline CL.

The fluid passage 134, as shown in the exemplary embodiment, is sized to accept the shiftable pin 84 of the self-contained valve unit 104. In particular, the fixed rigid nib 124 cooperates and supports the valve unit 104 to facilitate production and assembly of adjustable tip assemblies 120. For example, multiple rigid bodies 122 can be manufactured in an automated injection molding process and shipped to a central location for assembly with a like number of the preassembled second self-contained valve units 104. Thus, rigid bodies 122 and the valve units 104 can be directly assembled without the need for additional subassembly preparation or steps. However, the valve passage 134 or boss can be configured to securely accept the components of the valve unit 104 during an assembly process.

FIG. 6 illustrates an exploded view of the adjustable tip assembly 120. The fixed rigid nib 124 incorporates a neck portion 152 integrally connecting the cylindrical body 130 to the conical neck 64. The neck portion 152 cooperates with the cylindrical body 130 to fluidly connect the first angled marking surfaces 132 via the fluid passage 134 to the fluid reservoir (not shown). A groove 154 curves about an external surface 156 of the neck portion 152. The groove 154 defines a helical cam pattern to facilitate vertical and rotational translation of the adjustable rigid nib 126 about the centerline CL. Moreover, an unlocking notch 158 cooperates with the groove 154 to provide an unlocking path for vertically disconnecting the adjustable rigid nib 126 from the fixed rigid nib 124 and rigid body 122. The helical cam or groove 154 can be formed to include a dwell (e.g., a portion of the cam devoted to rotational translation only) as well as portions facilitating both vertical and rotational translation.

The adjustable rigid nib 126 includes a collar 136 formed to include a secondary cylindrical body 138 to provide the adjustable rigid nib 126 with a generally stepped appearance. In other words, the collar 136 has a diameter substantially larger than the diameter of the integral secondary cylindrical body 138. The rotatable collar 136 further includes a vertical rotation surface 140 adapted for grasping by the user. The vertical rotation surface 140 includes a finger 160 (see FIG. 7) extending inwardly therefrom and sized for insertion into the groove 154. In operation, when the user grasps the collar 136 and rotates the entire adjustable rigid nib 126 around the centerline CL, the finger 160 slides along the groove 154 to move the adjustable rigid nib 126 axially along the centerline CL.

The secondary cylindrical body 138 may further include a pair of opposing relief surfaces 142, 144 and a second angled marking surface 146. The opposing relief surfaces 142, 144 and the second angled marking surface 146 cooperate to define a secondary chisel shaped nib 148. The secondary chisel shaped nib 148 includes a nib passage 150 sized to rotatably accept the fixed rigid nib 124 when the two are adjacent about the centerline CL.

The finger 160 engages and aligns the adjustable rigid nib 126 to the unlocking notch 158 and the groove 154. In particular, the finger 160 cooperates with the unlocking notch 158 to insure that the adjustable rigid nib 126 vertically and rotationally engages the groove 154. In operation, the adjustable rigid nib 126, guided by slideable engagement of the finger 160 within the groove 152, circumscribes a corkscrew cam pattern having a vertical and rotational component about the centerline CL.

FIG. 7 illustrates a sectional view of the adjustable tip assembly 120 taken along the section line 7-7 of FIG. 5. The groove 154 cooperates with the finger 160 to guide the adjustable rigid nib 126 along the helical cam path. It will be understood that the groove 154 and the finger 160 can be arranged to assure that the first marking surface 132 and the second marking surface 146 form a complementary or composite angled marking surface (e.g., a substantially contiguous single surface) when the adjustable rigid nib 126 is positioned away from the connector 62. The complimentary or contiguous angled marking surface can, in turn, be oriented and aligned relative to the marking substrate (e.g., paper) to produce bold lines, such as lines having widths of approximately 3-10 mm.

While the final position (e.g., when the adjustable rigid nib 126 is farthest away from the connector 62) of the first marking surface 132 and the second marking surface 146 form the complimentary or contiguously angled marking surface, the initial position can include a variety of relative orientations. In particular, if the position of the first angled marking surface 132 is arbitrarily fixed at 0°, the second angled marking surface 146 can be 0°-360° out of alignment based on the shape and travel of the generally helical cam path defined by the groove 154.

Figure 8:
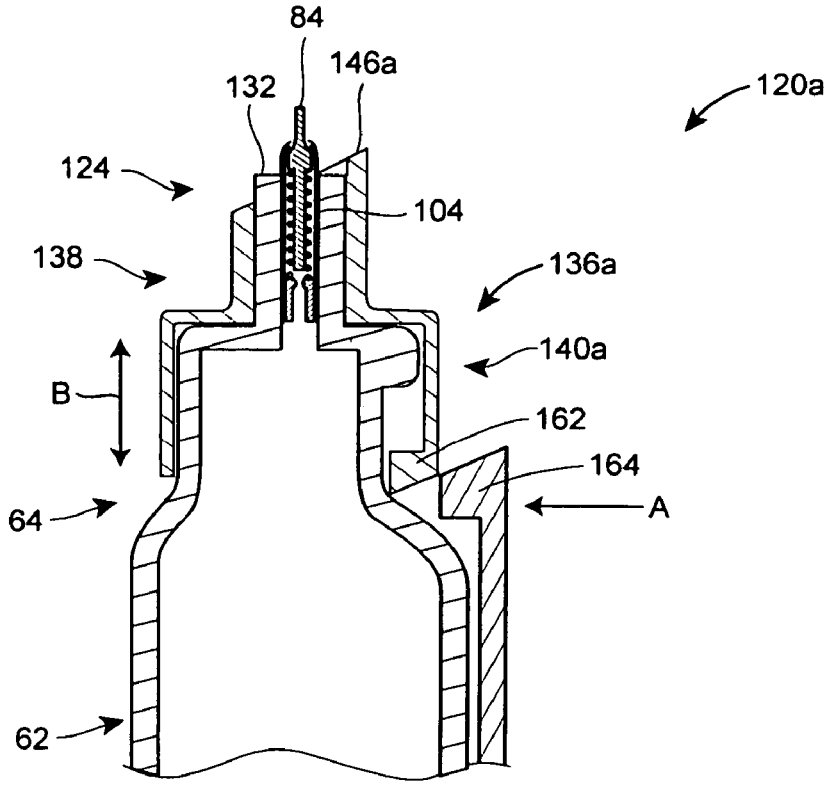
FIG. 8 illustrates a sectional view of another alternate exemplary marking tip.
Figure 9:
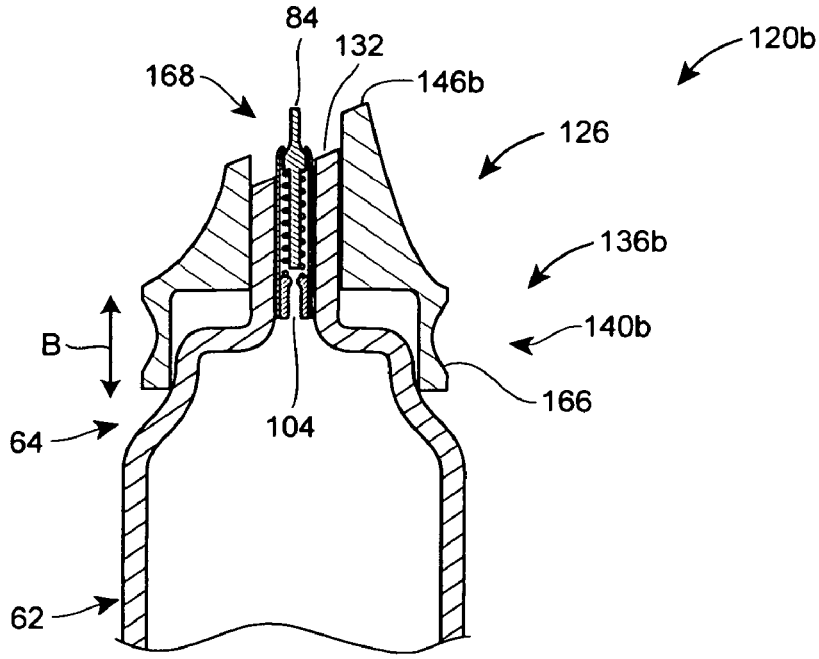
FIG. 9 illustrates a sectional view of yet another alternate exemplary marking tip.

FIGS. 8 and 9 illustrate alternate embodiments of the adjustable marking assembly 120*a* and 120*b*, respectively. The adjustable marking assemblies 120*a* and 120*b* include embodiments of the adjustable marking surfaces 146*a* and 146*b* adapted to linearly engage the fixed rigid nib 124.

FIG. 8 illustrates an adjustable marking assembly 120*a* that includes a collar 136*a* having a vertical surface 140*a*. The vertical surface 140*a* includes an integral cam surface 162 adapted to cooperate with an external cam 164. In operation, the external cam 164 translates in a radial direction, indicated by the arrow A, to force the cam surface 162 to translate in an axial in the direction, indicated by arrow B. The translation of the cam surface 162 drives the collar 136*a* and the secondary cylindrical body 138 to an extended position distal to the connector 62. In this way, the first marking surface 132, which houses the valve unit 104, and the second.marking surface 146*a* cooperate to form a non-complimentary, or noncontiguous angled marking surface (not shown). The second marking surface, in this exemplary embodiment, acts as a spreader to evenly distribute fluid dispensed by the valve unit 104 across the writing surface.

FIG. 9 illustrates an adjustable marking assembly 120*b* that can include a collar 136*b* having a vertical gripping surface 140*b*. The vertical gripping surface 140*b* can, for example, integrally include an indented grip 166 having a roughly concave shape to accept the user's fingers. It will be understood that the vertical gripping surface 140*b* can be a knurled or textured surface, or any other patterned intended to facilitate grasping of the collar 136*b*. In operation, the vertical gripping surface 140*b* translates in an axial direction, indicated by the arrow B, to shift the collar 136*b* to an extended position distal to the connector 62. In this way, the first marking surface 132 which may simply be the valve unit 104, as shown, and the second marking surface 146*b* cooperate to produce lines of fluid having larger widths.

In addition to mechanisms discussed herein, the angled marking surfaces 78, 132, 146, 146*a* and 146*b* may be flocked or otherwise covered with material to provide a textured, patterned, or roughened surface and define a spreader 168. The material used for the flocking feature can be secured to the angled marking surfaces 78, 132, 146, 146*a*, and 146*b* by a friction fit, a mechanical attachment, a chemical adhesive or any other desired method. The spreader 168, in turn, facilitates even and consistent spreading of the ink, writing fluid, correction fluid or other film forming fluid as it is applied to the marking substrate.

The material comprising the spreader 168 may be resistant to the solvents in the writing or correction fluids contained within the reservoir. Solvent resistant materials include a wide range of suitable compositions and structures such as metals, plastics, rubbers, fiber composites, flocked materials, wool felts and cellular materials and combinations of these materials. Appropriate selection of materials may depend on a number of factors including fluid to be dispensed, desired tactile feel of the writing assemblies, aesthetic considerations and other ergonomic factors.

One embodiment which may be employed to insure a smooth application of writing or correction fluid includes a combination of a self-contained ball type valve and a polytetrafluoroethylene (PTFE) polymer spreader. Another embodiment designed to impart a marker-like feel on the end-user may incorporate a pin-type valve applicator and a fiber composite spreader. A fiber composite advantageously does not allow flow through the fiber composite of the spreader, therefore, the porosity of the composite can be very low which increases its overall wear resistance.

It will be understood that additional factors which can influence the thickness of the deposited line are the speed at which the marker is moved relative to the marking substrate, the pressure differential between the atmosphere and the fluid stored in the reservoir, the viscosity of the stored fluid and the clearance between the spreading means and the writing surface. The dimensions of the spreader 168 can, in part, determine the width and consistency of the line. In addition, the area and size of the angled marking surfaces 78, 132, 146, 146*a* and 146*b* may be varied to produce lines of greater or lesser widths than discussed herein.

It will be further understood that the term "marking instrument" as used herein is intended to cover writing instruments, markers, correction fluids, liquid dispensers and other similar devices. Although marking instruments, valves and spreader combinations have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A tip assembly for a marking instrument having a body defining a fluid reservoir, the tip assembly comprising:

a first rigid nib comprising a first angled marking surface, the first angled marking surface defining an acute angle relative to a centerline of the first rigid nib, the first rigid nib being coupled to the body and having a fluid path formed longitudinally therethrough;

a moveable valve positioned within the fluid path, the moveable valve including a valve actuator; and a second rigid nib comprising a second angled marking surface, the second angled marking surface defining an acute angle relative to a centerline of the second rigid nib, the second rigid nib being disposed adjacent the first rigid nib and having a nib passage formed longitudinally therethrough, wherein the nib passage is sized to accept the first rigid nib and wherein the second rigid nib is placeable in a first extended position and a second retracted position; the second angled marking surface defining a second spreader surface positioned distal to the body, the second spreader surface cooperating with a first spreader surface defined by the first angled marking surface when the second rigid nib is in the first extended position to communicate fluid from the first rigid nib to the second spreader surface.

2. The tip assembly of claim 1, wherein the first spreader surface comprises a textured surface adapted to evenly spread the fluid contained within the fluid reservoir.

3. The tip assembly of claim 1, wherein the second rigid nib comprises a substantially oval nib.

4. The tip assembly of claim 3, wherein the first rigid nib is a plastic nib selected from the group consisting of a chisel tip, and an angled cylindrical tip, and a rectangular tip.

5. The tip assembly of claim 1, wherein the second spreader surface comprises a textured surface adapted to evenly spread the fluid contained within the fluid reservoir.

6. The tip assembly of claim 1, wherein the moveable valve comprises a ball point valve.

7. The tip assembly of claim 1, wherein the second spreader surface is flocked with a fibrous material to promote even spreading of the fluid contained within the fluid reservoir.

8. The tip assembly of claim 7, wherein the first rigid nib and the second rigid nib comprise plastic nibs cooperating to form a chisel tip.

9. The tip assembly of claim 1, wherein the first rigid nib and the second rigid nib comprise substantially cylindrical nibs.

10. The tip assembly of claim 1, wherein the second rigid nib is rotatable about a longitudinal axis between a first unlocked position and a second locked position.

11. The tip assembly of claim 1, wherein the first spreader surface and the second spreader surface cooperate to form a contiguous spreader surface.

12. The tip assembly of claim 1 wherein the first rigid nib and the second rigid nib cooperate to form a noncontiguous surface including a void between the second spreader surface and the first spreader surface.

13. A marking instrument comprising:

a body including a fluid reservoir;

correction fluid disposed in the fluid reservoir; and a tip assembly coupled to an open end of the body, the tip assembly comprising:

a rigid nib having a fluid path formed through a longitudinal axis, wherein the rigid nib has a first end for engaging a writing surface and second end adjacent to the fluid reservoir;

a shiftable valve unit positioned within the fluid path, the shiftable valve unit including a valve actuator having a contact surface positioned substantially adjacent to the first end; and an auxiliary nib having an auxiliary spreader surface, the auxiliary nib shiftable between an extended position and a retracted position, and adapted to cooperate with the rigid nib, wherein the auxiliary spreader surface and the first end cooperate to form a composite spreader surface when the auxiliary nib is in the extended position, and wherein the auxiliary nib is rotatable along a helical cam.

14. The marking instrument of claim 13, wherein the helical cam includes a dwell portion and a translation portion.

15. A marking instrument including a fluid reservoir, the fluid reservoir having an open end, the marking instrument comprising:

a tip assembly coupled to the open end, the tip assembly including:

a rigid nib having a longitudinally formed fluid path, wherein the rigid nib has a first end forming a spreader surface and a second end adjacent to the fluid reservoir;

an annular auxiliary rigid nib having a nib path sized to accept the rigid nib, wherein the auxiliary rigid nib has a first end forming an auxiliary spreader surface, the auxiliary rigid nib rotatable between an extended position and a retracted position; and a valve unit positioned within the fluid path, the valve unit including a valve actuator;

wherein the auxiliary spreader surface and the spreader surface cooperate to form a composite spreader surface when the auxiliary spreader surface is in the extended position; and wherein the annular auxiliary rigid nib includes a finger that cooperates with a helical cam to guide the annular auxiliary rigid nib from the retracted position to the extended position as the annular auxiliary rigid nib is rotated.

16. The marking instrument of claim 15 wherein the rigid nib and the auxiliary rigid nib comprise plastic nibs.

17. The marking instrument of claim 16, wherein the rigid nib and the auxiliary rigid nib cooperate to form a chisel tip.

18. The marking instrument of claim 15, wherein the spreader surface and the auxiliary spreader surface are each a textured surface adapted to evenly spread the fluid contained within the fluid reservoir.

19. The marking instrument of claim 15, wherein the helical cam is disposed in a neck portion of the rigid nib.

20. The tip assembly of claim 1, wherein the second rigid nib is rotatable from a first extended position to a second retracted position.

* * * * *